US007232186B1

(12) United States Patent
Chi

(10) Patent No.: US 7,232,186 B1
(45) Date of Patent: Jun. 19, 2007

(54) DEPTH-ADJUSTABLE DEVICE FOR A CHAIR

(76) Inventor: Ching-Hui Chi, No. 157, Fusing Rd., Taoyuan City, Taoyuan County 330 (TW)

( * ) Notice: Subject to any disclaimer, the term of this patent is extended or adjusted under 35 U.S.C. 154(b) by 0 days.

(21) Appl. No.: 11/343,612

(22) Filed: Jan. 30, 2006

(51) Int. Cl.
*A47C 1/00* (2006.01)

(52) U.S. Cl. ..... 297/344.1

(58) Field of Classification Search ..... 297/344.1, 297/337, 463.1; 248/429
See application file for complete search history.

(56) References Cited

U.S. PATENT DOCUMENTS 1,326,417 A * 12/1919 Paine ..... 248/158
2,001,999 A * 5/1935 Bishop ..... 384/15
3,542,326 A * 11/1970 Reapsummer ..... 297/344.1
4,209,159 A * 6/1980 Becker et al. ..... 248/430
6,105,921 A * 8/2000 Carrig et al. ..... 248/429

* cited by examiner

*Primary Examiner*—Milton Nelson, Jr.
(74) *Attorney, Agent, or Firm*—Charles E. Baxley

(57) ABSTRACT

A depth-adjustable device for a chair comprises a rail rack, the railway is formed with a V-shaped concave, and the supporting board is slideably disposed in the railway by four clipping blocks, and in the lower part of each clipping block is formed a V-shaped convex. The inclined concave cooperates with the inclined convex to allow the adjustment device operate firmly. The V-shaped convex of the clipping blocks moveably abuts against the V-shaped concave in the bottom of the respective railways of the rail base, so that the gravity will be focused on the center and the supporting board and the rail base will slide relative to each other but will not wobble and impact each other, thus reducing the operation noise effectively.

6 Claims, 8 Drawing Sheets

PROR ART

DEPTH-ADJUSTABLE DEVICE FOR A CHAIR

BACKGROUND OF THE INVENTION

1. Field of the Invention

The present invention relates to an adjustable device for a chair, and more particularly to a depth-adjustable device for a chair that is free of the problem of wobble and noise.

2. Description of the Prior Art

Since different modern designs are used more and more widely in various chairs, various chairs with different adjustment mechanisms, such as chair with pneumatic height-adjustment structure, and spring type recliner, etc, have come into existence in our everyday life.

For example, a conventional depth-adjustable device for an office chair is shown in FIGS. 1 and 2, wherein a supporting board 10 for supporting the chair body (not shown) is slideably mounted on a railway 111 of a rail rack 11. The rail rack 11 is fixed to the chair foot 12, and a rotating handle 13 is pivotally mounted on the rail rack 11 and has a protruded block 131 engaged in a tooth groove 101 in a side of the supporting board 10. However, this conventional depth-adjustable device still has the following problems:

Firstly, since the supporting board 10 is slideably mounted on the square-shaped railway 111 of the rail rack 11, it will cause the shift of the center of gravity of the user when the weight of the person and the chair are applied to the supporting board 10. And the gap in the square-shaped railways 111 will make the rail rack 11 keep impacting the supporting board 10, causing wobble, and even worse, the wobble may cause the disengagement of the supporting board 10 out of the railway 111 of the rail rack 11.

Secondly, the rotating handle 13 is pivotally mounted on the rail rack 11 and has a protruded block 131 engaged in a tooth groove 101 in a side of the supporting board 10. However, the protruded block 131 and the tooth groove 101 are square-shaped in cross section, there will be a gap A between the protruded block 131 and the tooth groove 101, and this gap will also cause the supporting board to wobble or to disengage from the railway 111 of the rail rack 11.

Thirdly, no matter the supporting board 10 impacts the rail rack 11 or the protruded block 131 impacts the tooth groove 101, it will cause noise.

The present invention has arisen to mitigate and/or obviate the afore-described disadvantages.

SUMMARY OF THE INVENTION

The primary objective of the present invention is to provide a depth-adjustable device for a chair that is free of the problem of wobble and noise.

The depth-adjustable device for a chair includes a rail rack, the railway is formed with a V-shaped concave, and the supporting board is slideably disposed in the railway by four clipping blocks, and in the lower part of each clipping block is formed a V-shaped convex. The inclined concave cooperates with the inclined convex to allow the adjustment device operate firmly. The V-shaped convex of the clipping blocks moveably abuts against the V-shaped concave in the bottom of the respective railways of the rail base, so that the gravity will be focused on the center and the supporting board and the rail base will slide relative to each other but will not wobble and impact each other, thus reducing the operation noise effectively.

Another object of the present invention is to provide a depth-adjustable device for a chair which can reduce the noise efficiently.

To achieve the aforesaid object, the protruded button is in close contact with the rack through the inward inclined surfaces, and the inclined concave cooperates with the inclined convex to allow the adjustment device operate firmly, so as to solve the problem of wobble, noise of the chair.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
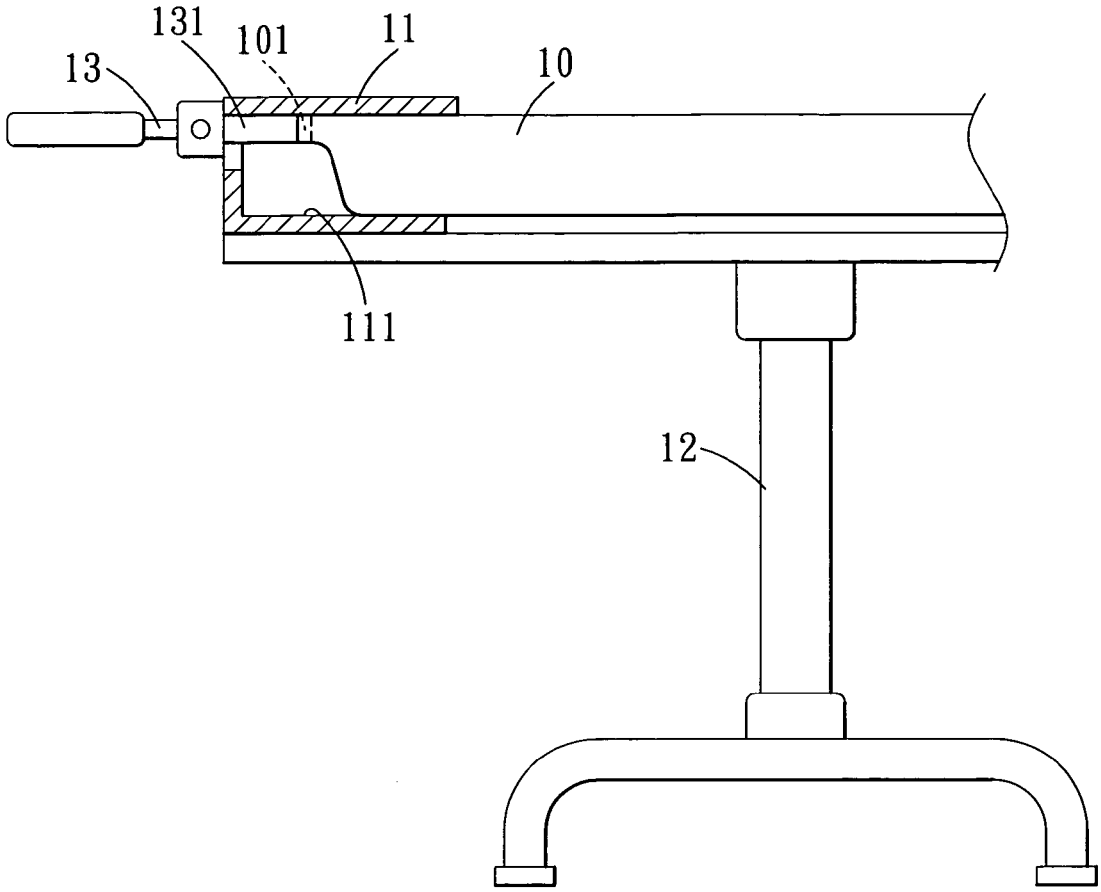
FIG. 1 PRIOR ART
FIG. 1 is a sectional view of a conventional chair.
Figure 2:
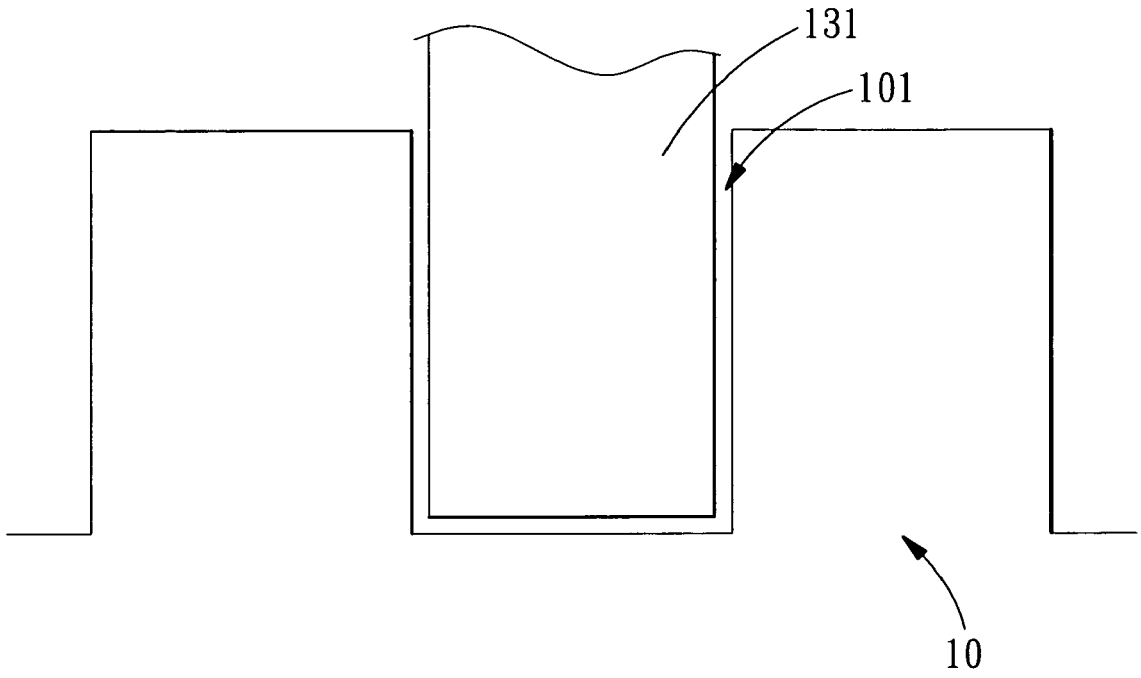
FIG. 2 is a partial enlarged view of the conventional chair.
Figure 3:
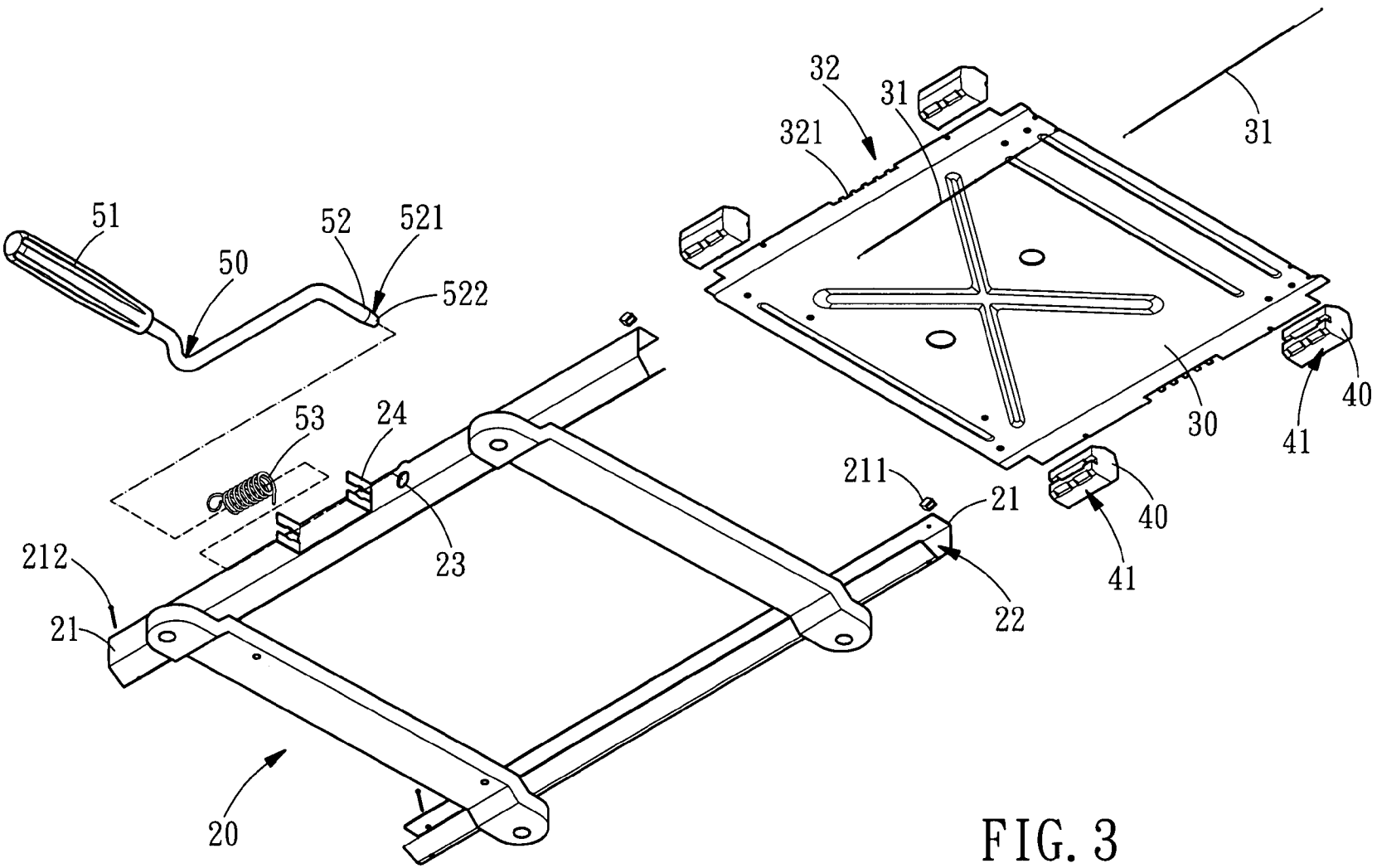
FIG. 3 is an exploded view of a height-adjustable device for a chair in accordance with the present invention.
Figure 4:
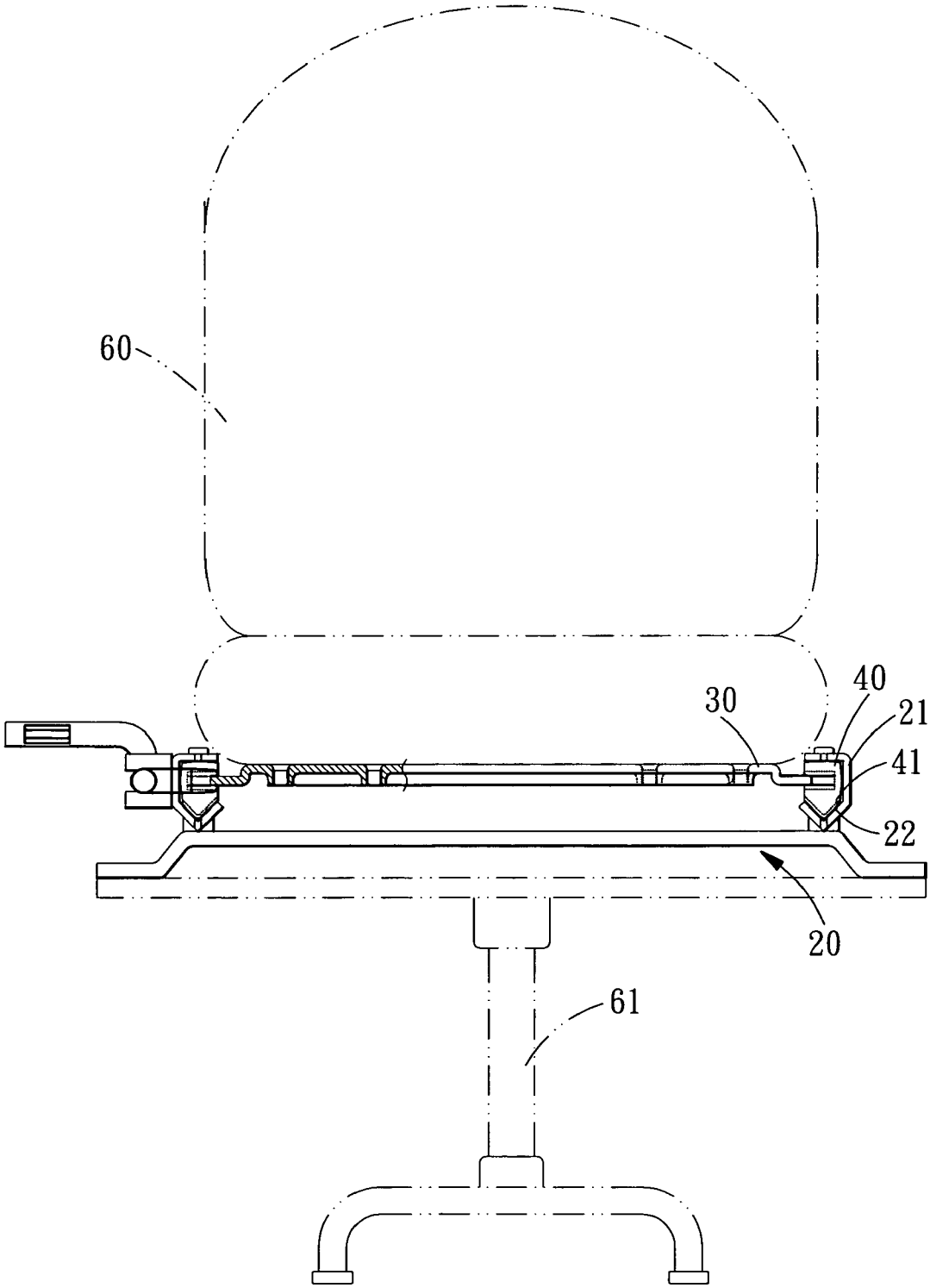
FIG. 4 is an illustrative view of the height-adjustable device for a chair in accordance with the present invention.
Figure 5:
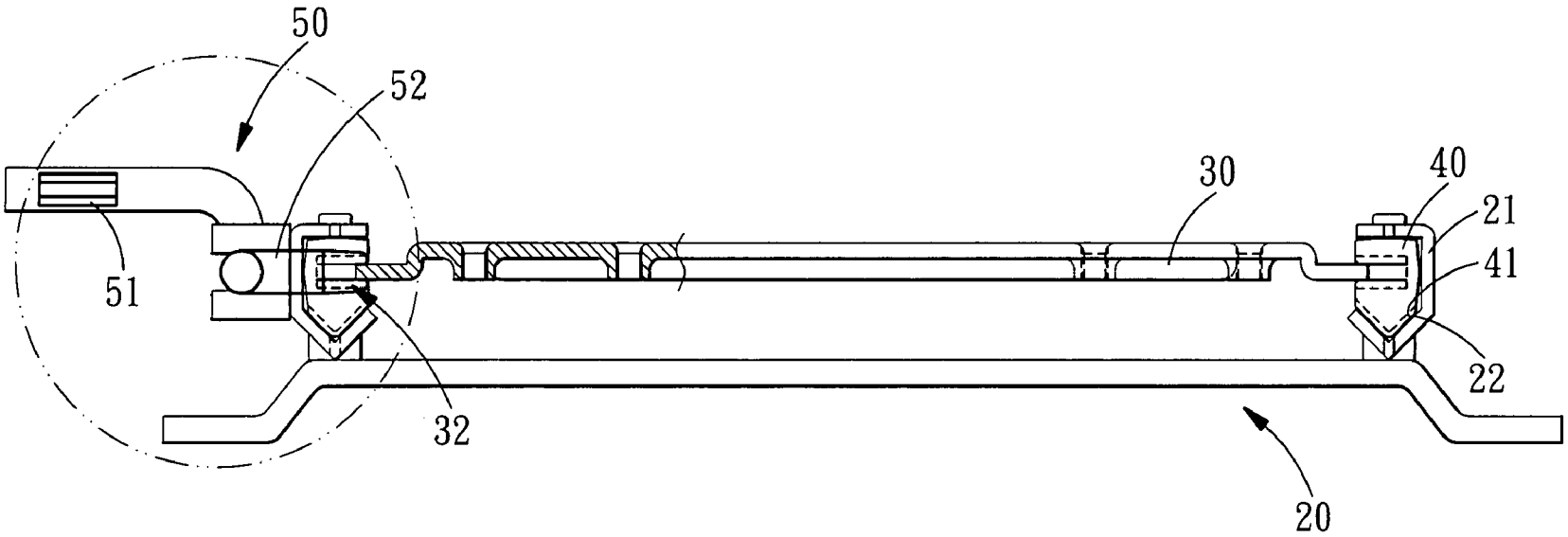
FIG. 5 is an assembly cross sectional view of the height-adjustable device for a chair in accordance with the present invention.

Referring to FIGS. 3–5, a depth-adjustable device for a chair in accordance with the present invention is located between a chair body 60 and a chair foot 61 and comprises a rail base 20, a supporting board 30, four clipping blocks 40 and a locating pin 50.

The rail base 20 is provided with two opposite railways 21, and a V-shaped concave 22 is formed in the bottom of the respective railways 21. A locating block 211 and a blocking rod 212 are fixed on both ends of each railway 21, respectively. A long through hole 23 is defined in a side of one of the railways 21, and a rack 24 is disposed beside the long through hole 23.

Each side of the supporting board 30 is disposed with two clipping blocks 40 that are to be received in the two opposite railways 21 of the rail base 20 respectively. Each clipping block 40 is formed with a V-shaped convex 41 for mating with the railway 21. A spring 31 is biased between the supporting board 30 and the rail base 20. A rack 32 is formed in the supporting board 30 and located correspondingly to the side of the long through hole 23, and an inward-inclined surface 3211 (as shown in FIG. 8) is formed at both sides of the tooth groove 321 of the rack 32.

The locating pin 50 is pivotally mounted on the rack 24 of the rail base 20 together with the spring 53. A handle 51 is mounted on the outer end of the locating pin 50, and the other end of the locating pin 50 is formed with a protruded button 52 that is inserted into the long through hole 23, and the biggest external diameter of a protruded button end 521 of the protruded button 52 is a little larger than the tooth groove 321. An inward inclined surface 522 is formed on the protruded button end 521 for mating with the tooth groove 321 (the protruded button end 521 of this embodiment is cone-shaped).

Figure 6:
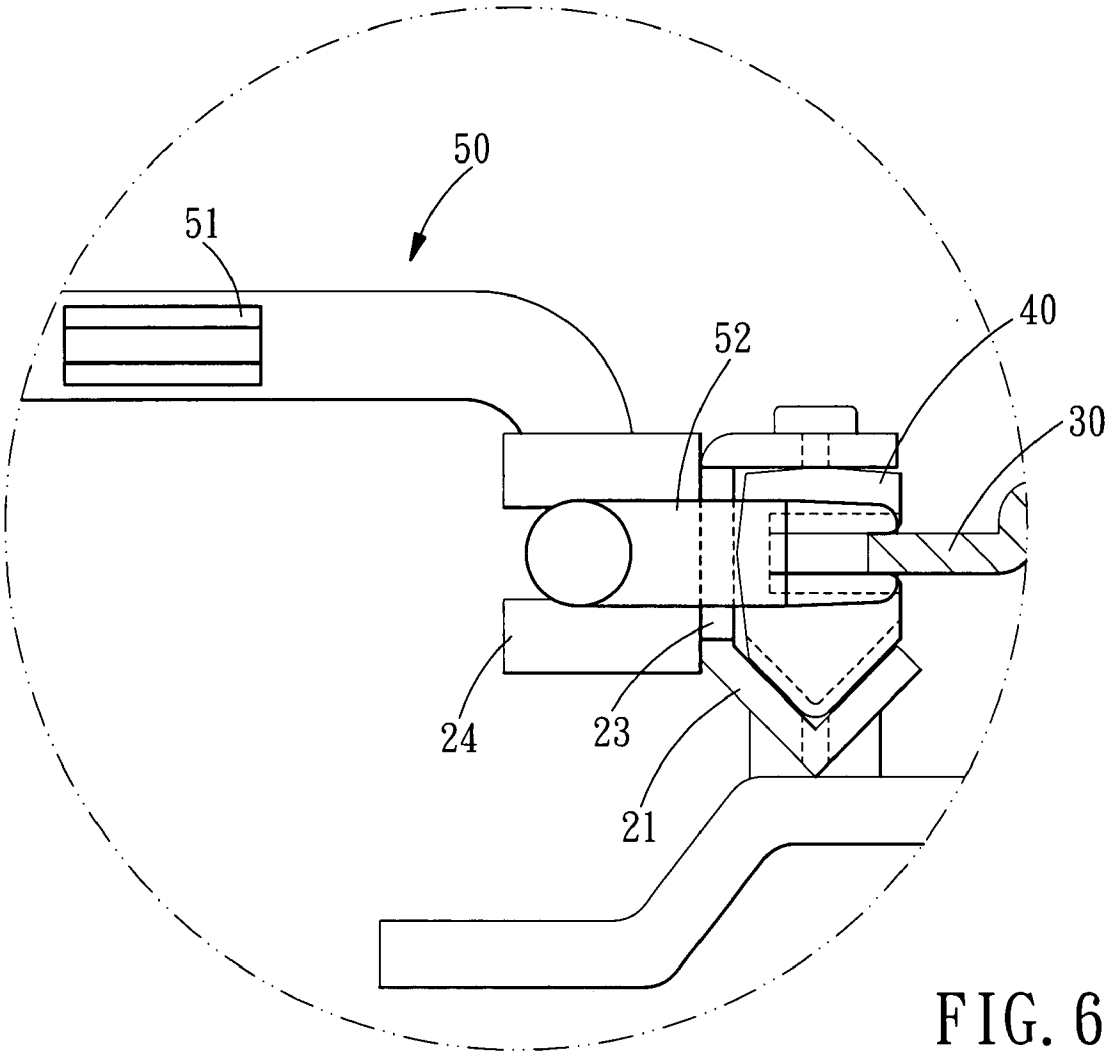
FIG. 6 is an assembly enlarged view of the height-adjustable device for a chair in accordance with the present invention.
Figure 7:
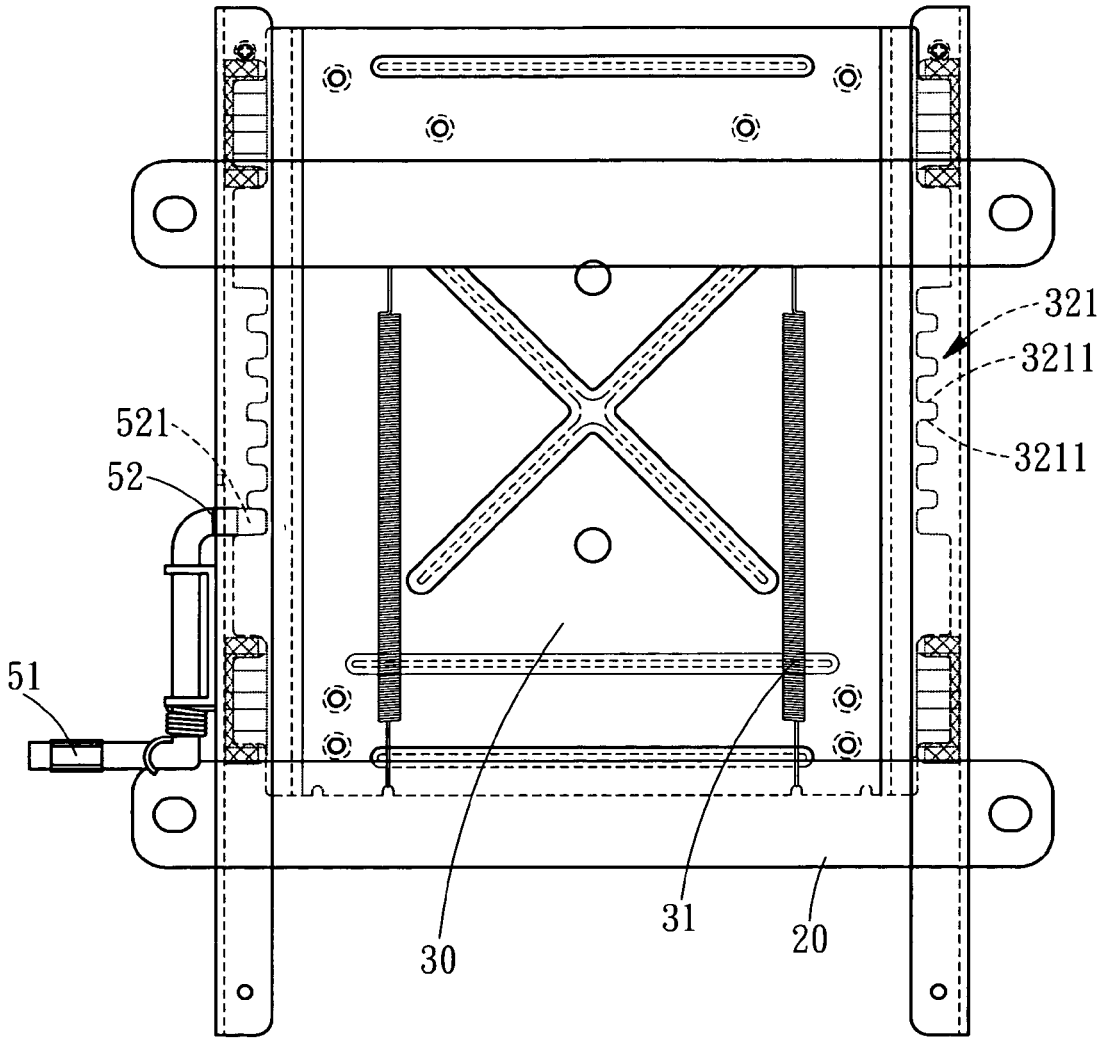
FIG. 7 is an assembly plan view of the height-adjustable device for a chair in accordance with the present invention.
Figure 8:
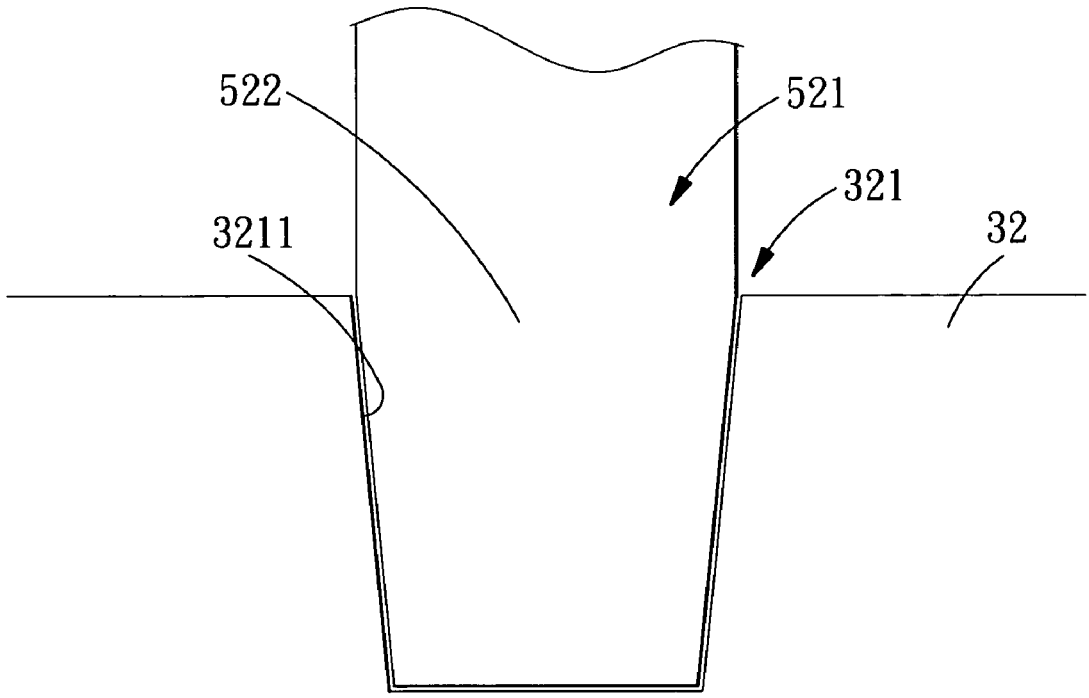
FIG. 8 is a partial enlarged view of the height-adjustable device for a chair in accordance with the present invention.

Referring further to FIGS. 6–8, since each side of the supporting board 30 is disposed with two clipping blocks 40, and each of the clipping blocks 40 is formed with a V-shaped convex 41 for mating with the railway 21. When the supporting board 30 carries the weight of the user and the chair body 60, the V-shaped convex 41 of the clipping blocks 40 will moveably abut against the V-shaped concave 22 in the bottom of the respective railways 21 of the rail base 20, so that the gravity will be focused on the center and the supporting board 30 and the rail base 20 will slide relative to each other but will not wobble and impact each other, thus reducing the operation noise effectively.

Another major characteristic of the present invention is described as follows:

When the supporting board 30 and the rail base 20 are positioned relative to one another and the user doesn't pull the locating pin 50, the protruded button 52 is inserted into the long through hole 23, and the spring 53 pushes the protruded button end 521 into the tooth groove 321 of the rack 32. Since the inclined surface 522 is formed on the protruded button end 521 for mating with the inward inclined surfaces 3211 of the tooth groove 321 (the protruded button end 521 of this embodiment is cone-shaped), the gap between the protruded button end 521 and the tooth groove 321 will be reduced, accordingly, the gap between the supporting board 30 and the rail base 20 will also be reduced, so that the supporting board 30 and the rail base 20 will not wobble and impact after being positioned, and thus the noise is reduced effectively.

When the user pulls the handle 51 that is formed on the outer end of the locating pin 50 (the spring 53 will be compressed), the protruded button 52 will be still inserted in the long through hole 23, but the protruded button end 521 will be pushed out of the tooth groove 321 by the spring 53. Thereby the supporting board 30 and the rail base 20 will move relative to each other (or will be pushed back to their original positions by the spring 53).

Furthermore, when the user releases handle, the inclined surface 522 of the protruded button end 521 will be pushed into the inward inclined surfaces 3211 of the tooth groove 321 again, accordingly, the gap between the supporting board 30 and the rail base 20 will also be reduced, so that the supporting board 30 and the rail base 20 will not wobble and impact after being positioned, and thus the noise is reduced effectively.

The aforementioned depth-adjustable device can be used for various kinds of chair body 60 and chair foot 61, and as for the method of jointing the chair body 60 and the chair foot 61, we will not discuss here since it is not the aim of the present invention.

In conclusion, the present invention comprises a rail base, a supporting board, several clipping blocks and a locating pin. The railway is formed with a V-shaped inclined concave, and the supporting board is slideably disposed in the railway by the clipping blocks. In the lower part of each clipping block is formed a V-shaped convex, and the locating pin is positioned in the rail base. A protruded button formed on the locating pin is engaged with the rack of the supporting board, and is in contact with the rack through their respective inward inclined surfaces. By such arrangements, the depth of the chair body is adjustable, and the protruded button can be in close contact with the rack through the inward inclined surfaces, and the inclined concave cooperates with the inclined convex to allow the adjustment device operate firmly, so as to solve the problem of wobble, noise of the chair.

While we have shown and described various embodiments in accordance with the present invention, it should be clear to those skilled in the art that further embodiment may be made without departing from the scope of the present invention.

What is claimed is:

1. A depth-adjustable device for a chair being located between a chair body and a chair foot, comprising: a rail base, a supporting board, several clipping blocks and a locating pin, wherein:

the rail base is provided with several railways, and in the bottom of each railway is formed a V-shaped concave, a locating block and a blocking rod are fixed on both ends of each railway, respectively, and a long through hole is defined in a side of one railway, and a rack is disposed beside the long through hole;

each side of the supporting board is disposed with clipping blocks that are slid into the railways of the rail base respectively, and the clipping blocks are formed with V-shaped convexes for mating with the V-shaped concaves, and a rack is formed in the supporting board corresponding to the side of the long through hole, and formed on two sides of a tooth groove of the rack are inward inclined surfaces; and the locating pin is mounted on the rack of the rail base together with a spring, and a handle is formed on the outer end of the locating pin, and on the other end is formed with a protruded button that is inserted into the long through hole, and the protruded button end is positioned in the tooth groove of the supporting board corresponding to an inward inclined surface, and the protruded button end is formed with an inward inclined surface for mating with the inward inclined surfaces at both sides of the tooth groove.

2. The depth-adjustable device for a chair as claimed in claim 1, wherein a spring is disposed between the supporting board and the rail base.

3. The depth-adjustable device for a chair as claimed in claim 1, wherein each end of the railway of the rail base is provided with a locating block and a blocking rod or one of the locating block and the blocking rod.

4. The depth-adjustable device for a chair as claimed in claim 3, wherein a spring is disposed between the supporting board and the rail base.

5. The depth-adjustable device for a chair as claimed in claim 3, wherein a larger external diameter of the protruded button end of the protruded button is a little larger than the tooth groove of the rack.

6. The depth-adjustable device for a chair as claimed in claim 5, wherein the protruded button end of the locating pin is cone-shaped.

* * * * *